US008303732B2

(12) United States Patent
Suzuki et al.

(10) Patent No.: US 8,303,732 B2
(45) Date of Patent: Nov. 6, 2012

(54) RARE EARTH MAGNET

(75) Inventors: Hiroyuki Suzuki, Hitachi (JP); Takao Imagawa, Mito (JP); Yuichi Satsu, Hitachi (JP); Matahiro Komuro, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 148 days.

(21) Appl. No.: 12/696,074

(22) Filed: Jan. 29, 2010

(65) Prior Publication Data

US 2010/0194509 A1 Aug. 5, 2010

(30) Foreign Application Priority Data

Feb. 2, 2009 (JP) ..... 2009-021091

(51) Int. Cl.
*H01F 1/057* (2006.01)

(52) U.S. Cl. ..... 148/302; 148/101; 148/103; 148/122

(58) Field of Classification Search ..... None
See application file for complete search history.

(56) References Cited

U.S. PATENT DOCUMENTS

| | | | | |
|---|---|---|---|---|
| 5,674,327 | A * | 10/1997 | Yamamoto et al. | 148/302 |
| 6,527,874 | B2 * | 3/2003 | Li | 148/301 |
| 6,814,776 | B2 | 11/2004 | Kanekiyo et al. | |
| 7,217,328 | B2 | 5/2007 | Nishiuchi | |
| 7,914,695 | B2 | 3/2011 | Satsu et al. | |
| 2005/0284545 | A1 | 12/2005 | Komuro | |
| 2007/0125452 | A1 * | 6/2007 | Hirota et al. | 148/302 |
| 2008/0092994 | A1 * | 4/2008 | Satsu et al. | 148/248 |
| 2008/0241368 | A1 | 10/2008 | Komuro et al. | |
| 2008/0241513 | A1 | 10/2008 | Komuro et al. | |
| 2008/0317620 | A1 | 12/2008 | Suzuki et al. | |

FOREIGN PATENT DOCUMENTS

| | | |
|---|---|---|
| CN | 1713313 A | 12/2005 |
| JP | 61-264157 | 11/1986 |
| JP | 06-069009 | 3/1994 |
| JP | 2003-49204 | 2/2003 |
| JP | 2003-224010 | 8/2003 |
| JP | 2006-066853 | 3/2006 |
| JP | 2007-281433 | 10/2007 |
| JP | 2008-266767 | 11/2008 |
| JP | 2008-270699 | 11/2008 |
| JP | 2008-282832 | 11/2008 |
| WO | WO 2006/043348 A1 | 4/2006 |

OTHER PUBLICATIONS

Japanese Office Action of Appln. No. 2009-021091 dated Apr. 19, 2011 with partial translation.

* cited by examiner

*Primary Examiner* — John Sheehan
(74) *Attorney, Agent, or Firm* — Antonelli, Terry, Stout & Kraus, LLP.

(57) ABSTRACT

A rare earth magnet having a composition represented by RTB wherein R denotes a rare earth element, T a transition metal and B boron, the magnet being composed of magnet powder constituted by crystalline particles. The particles of the magnetic powder have a ratio of a short diameter being 10 μm or more to a long diameter is 0.5 or less. An element Rm having a magnetic anisotropy higher than that of the rare earth element is contained in the surface and inside of the magnet constituted by the magnet powder in an approximately constant concentration. An oxy-fluoride and carbon are present at boundaries of the particles of the magnet powder.

12 Claims, 4 Drawing Sheets

RARE EARTH MAGNET

CLAIM OF PRIORITY

The present application claims priority from Japanese Patent Application Serial No. 2009-21091, filed on Feb. 2, 2009, the content of which is hereby incorporated by reference into this application.

FIELD OF THE INVENTION

The present invention relates to a rare earth magnet.

BACKGROUND ART

Magnets prepared by adhering dysprosium (Dy), terbium (Tb) and their chemical compounds to a sintered body, followed by thermal diffusion along grain boundaries of crystals can suppress use amounts of Dy and Tb for enhancing coercive force (Hc), compare to those of magnets wherein Dy and Tb are added homogeneously to a mother phase thereof, and can maintain a high residual magnetic flux density (Br).

As prior art that utilizes a grain boundary diffusion technique for Dy, Tb and their chemical compounds from the surface of the magnet, patent document No. 1 discloses a magnet wherein Dy utilizing its low vapor pressure is adhered to the surface of the magnet, patent document No. 2 discloses a sintered magnet wherein Dy—F slurry is coated on the sintered body, followed by grain boundary diffusion, patent document No. 3 discloses a magnet wherein a treating solution of Dy—F and Tb—F in a sol-gel state is coated on the magnet and magnet powder, followed by adhering them to the magnet by drying. The magnets disclosed in the prior art are featured by high coercive force and high magnetic residual flux density. Patent document No. 4 discloses a magnet wherein an isotropic magnet powder treated with Dy—F and Tb—F solution is shaped at room temperature, which is featured by high productivity.

Patent document No. 1; Japanese Patent laid-open S61-264157

Patent document No. 2; WO 2006/043348

Patent document No. 3; Japanese Patent Laid-open 2006-66853

Patent document No. 4; Japanese Patent Laid-open 2007-281433

Although magnets having a small thickness prepared by adhering dysprosium (Dy), terbium (Tb) and their chemical compounds to the sintered body, followed by thermal diffusion along the crystalline grain boundaries exhibit remarkable enhancement of magnetic characteristics with respect to thin magnets, little enhancement of magnetic characteristics are observed in thick magnets because thermal diffusion of the elements into the center portion of the magnet. In addition since there is a distribution of coercive force in the inside of the magnets, which must be controlled by amounts of adhering, thermal treatment temperatures and heat treatment time, it is difficult to produce magnets with constant characteristics at one time.

The concentration of RTB elements are substantially constant throughout the magnet, which is composed of crystal grains of magnet powder. The concentration of the elements in a crystal grain is not constant between the surface and the inside.

SUMMARY OF THE INVENTION

Accordingly, an object of the present invention is to provide a magnet whose thermal demagnetization is suppressed and high Br at high temperature circumstances is maintained.

The present invention provides a magnet having RTB wherein R denotes a rare earth element, T a transition metal and B boron, the rare earth magnet being composed of magnet powder constituted by crystalline particles, wherein the magnet powder has a flat form, wherein an element Rm having a magnetic anisotropy higher than that of R is contained in the surface and in the inside of the magnet at an approximately constant concentration throughout the magnet, and wherein an oxy-fluoride and carbon are present at grain boundaries.

DETAILED DESCRIPTION OF THE PREFERRED EMBODIMENTS

Figure 1:
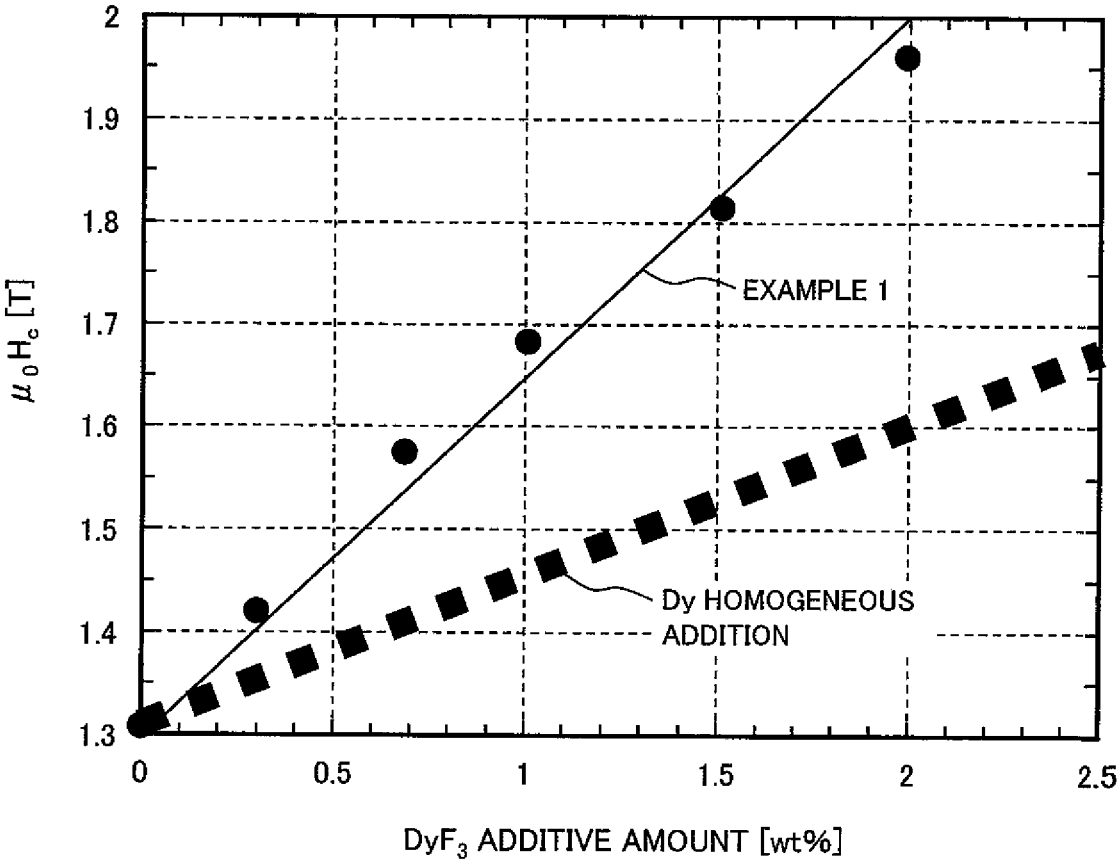
FIG. 1 is a graph showing coercive force of magnets prepared by a method of example 1.

Features and advantages of the present invention will be explained in the following.

Rare earth magnets of the examples of the present invention has a composition of RTB wherein R denotes a rare earth element, T a transition metal and B boron, the rare earth magnet being composed of magnet powder constituted by crystalline particles, wherein a ratio of a short diameter of the magnet powder to a long diameter is 0.5 or less, the short diameter is 10 μm or less, wherein an element Rm that exhibits magnetic anisotropy higher than that of R is contained in the surface and inside of the magnet at an approximately constant concentration, and wherein an oxy-fluoride and carbon are present at grain boundaries of the magnet powder. In comparing magnetic anisotropy of each element there is such a relationship as Tb>Pr>Dy>Nd>Ho>Ce>Y>Gd>Sm. The anisotropy becomes smaller towards right direction. Therefore, if Nd is used as R, one or more of Tb, Pr and Dy. Magnetic anisotropy of Er and Tm is almost the same as Sm. In the specification the magnetic anisotropy is magnetocrystalline anisotropy.

In addition the rare earth magnet of the present invention is featured by a concentration of Rm in the surface portion higher than that in the inside thereof.

Further, the concentration of Rm in the surface portion of the crystalline particles is higher than that in the inside of the crystalline particles.

Still further, an oxy-fluoride and carbon are present at grain boundaries of the crystalline particles.

Further, the oxy-fluoride at the grain boundaries is present as islands form.

Concerning a composition of the rare earth magnet, Rm is at least one member selected from the group consisting of Nd, Tb, Dy, Pr, Ce and Ho, and the magnet powder contains Ga and at least one member selected from the group consisting of Nd, Pr, Fe, Co and B.

According to one example of the present invention, the rare earth magnet has a composition represented by RTB wherein R denotes a rare earth element, T a transition metal and B boron, wherein the magnet is composed of magnet powder constituted by crystalline particles, wherein the particles of the magnetic powder have a flat form, wherein an oxy-fluoride and carbon are present at boundaries of the particles of the magnet powder, wherein an element Rm having magnetic anisotropy higher than that of the rare earth element is contained in the surface and inside of the magnet constituted by the magnet powder in an approximately constant concentration, and wherein a concentration of Rm in the surface of the magnet powder is higher than inside of the magnet powder.

In the above example, a size of the crystalline particle in c-axis is 30 to 100 nm, and a size in a direction perpendicular to the c-axis is 100 to 400 nm.

Further, if Rm is at lest one of Nd, Tb, Dy, Pr, Ce and Ho, R is Nd and T is Fe.

In the following examples of the present invention will be explained in detail.

EXAMPLES

In fabricating a permanent magnet for an electric rotating machine it is possible to compact-mold a permanent magnet with a final shape. According to a method described below, the size of the compact-molded magnet is not hardly changed at the later steps. Therefore it is possible to fabricate magnets with high dimension precision. As a result, a size precision required for the permanent magnet type electric rotating machine can be achieved. For example, it is possible to obtain a size precision required for electric rotating machines of magnet-built-in type. On the other hand, in sintered type, size precision of the magnets is very bad, and thus a machining of the magnets is necessary. This makes productivity worse, as well as lowering magnetic characteristics of the magnet by cutting processing.

Magnet powder crashed thin strips produced by rapid cooling molten metal of NdFeB alloy were used. The NdFeB molten alloy was prepared by adding Nd to a molten Fe—B alloy in vacuum, an inert gas atmosphere or a reducing gas atmosphere to make the composition of the mother alloy homogeneous. If necessary, cut mother alloy was melted and the molten mother alloy was injected onto the surface of a rotating roll in an inert gas atmosphere such as argon gas atmosphere or a reducing gas to rapidly cool the injected mother alloy to thereby produce thin strips, and then the strips are heat treated in the inert gas atmosphere or in the reducing gas atmosphere. The heating treatment temperature should preferably be 200 to 700° C., by which the micro-crystals of $Nd_2Fe_{14}B$ precipitate and grow in the magnet powder as crystalline grains. The thin strips have a thickness distribution of 10 to 100 μm.

The grain boundaries have a composition close to $Nd_{0.7}Fe_{0.3}$ or where part of Fe precipitates. Since a grain size of the crystalline particles is smaller than a critical diameter of the single magnetic domain being 200 nm, magnetic domain wall are hardly formed in the micro-crystals of $Nd_2Fe_{14}B$.

As a magnetic inversion mechanism, inverse magnetic domain generation type and magnetic domain wall pining type have been proposed. The chain propagation of reverse magnetic domains by the magnetic dipole interactions, which are magnetically coupled with the magnetized micro-crystals of $Nd_2Fe_{14}B$ may be one factor that causes the magnetic inversion mechanism.

When the ground powder is put in a mold made of super hard alloy to compact-mold it, the compact-molding has little of non-magnetic part among the magnetic powder particles in a direction of the press direction.

Since the ground magnetic powder that is made from the thin strips has a flat form, and since there is slide of crystal grains due to plastic flow at the time of compact-molding under heating and crystal grain growth, orientation of flat form powder of the heat compact-molding generates anisotropy so that short axes of the flat form powder are oriented in the press direction and the long axes of the flat form powder are oriented in the direction perpendicular to the press direction.

The c-axes of the crystal grains are oriented in the press direction in the flat form powder. Therefore, if the flat form powder were considered as one magnetic dipole, it may be possible to employ as one method for suppressing magnetic inversion that the non-magnetic part is made thin so as to make it easy to magnetically couple the ground magnetic powder in a longitudinal direction and to make the thickness of the non-magnetic part thick so as to make it difficult to magnetically couple the ground magnetic powder in the press direction.

In this example MQU-F3 manufactured by Magnequnch, Inc. was used. IPC illumination analysis showed the composition of the magnet powder wherein Nd was 28.5%, Pr was 0.1%, Fe was 29.2%, Co was 2.9%, and Ga was 0.25% all by weight.

Addition of Ga makes slide of the magnet powder easy by a die-setup method so that orientation of the magnetic powder becomes easy. The magnetic powder had flat form and a particle size distribution had a peak in the range of 100 to 200 μm. The die setup method is a method for manufacturing permanent magnets, wherein plastic deformation produces plastic flow and orientation of crystal grains in a vertical direction.

On the other hand, a treating solution for coating a fluoride of rare earth element or fluoride of alkaline earth metal was prepared in the following manner. An example is $DyF_3$. 4 grams of dysprosium acetate or dysprosium nitrate was dissolved in 100 L of water, and the hydrogen fluoric acid of 1% concentration was gradually added to the dysprosium solution at 90% of an amount necessary to produce dysprosium fluoride $DyF_3$ to thereby to produce gelatinous $DyF_3$.

After the solution was subjected to filteration to remove a supernatant, methanol in an amount equal to the residual gel was added. Stirring and centrifugation were repeated 3 to 10 times to remove anionic ions to produce almost transparent colloidal $DyF_3$ methanol solution (concentration: $DyF_3$/methanol=1 g/5 mL). The stirring and centrifugation were repeated 10 times to completely remove cationic ions. The fluorides of rare earth elements and, if desired, fluorides of alkaline earth metals are used to coat the surface of the magnet powder to form a film. The resulting coated magnet powder is subjected to compact-molding or the die setup method. The fluorides of the rare earth elements contribute to enhance coercive force. An amount of RTB should preferably be 90% by weight or more per weight of the magnet.

The rare earth magnet powder for rare earth magnet was prepared using the rare earth fluoride or alkaline earth metal fluoride treating solution in the following manner.

10 mL of the $DyF_3$ coating solution was added to 100 grams of magnet powder containing rare earth element and having an average particle size of 100 to 200 μm until the entire of the magnet powder is wet. The wetted magnet powder was subjected to a methanol removal processing in a reduced pressure of 2 to 5 torr. The magnet powder after the methanol removal was transferred to a quartz boat, and the powder was heat-treated at 200° C. for 30 minutes in a reduced pressure of $1\times10^{-3}$ Pa. Further, the powder was heat-treated at 350° C. for 30 minutes. As a result, 2% by weight of $DyF_3$ per the magnet powder was applied.

A heat compact-molding method was applied to the $DyF_3$ treated magnet powder prepared in the above-mentioned process. The DyF3 treated magnet powder and non-treated magnet powder were mixed to adjust an amount of $DyF_3$ per the total amount of the magnet powder. After thorough mixing of the magnet powders the total weight was 5.0 grams.

The magnet powders were charged in a super hard mold made of tungsten carbide WC (10 mmm×10 mmm), and were compact-molded at 700° C. under a load of 2 tons and 1 ton in a reduced atmosphere of $1\times10^{-4}$ Pa. Thereafter the heat-treated magnet powder was put in another WC mold and heat-treated at 700° C. for one minutes in a reduced atmosphere under a load of 2 tons and 1 ton. The magnet powder was placed in the mold in which a height of the magnet changes by 75%.

The minimum thickness of the resulting molding was 6 mm, and a density was 7.5 g/cm$^3$. Since the size of the WC mold can be changed, there is no limit of a thickness of magnets in theory.

A preferable heating temperature was 200 to 900° C., a more preferable temperature was 500 to 800° C., and the most preferable temperature was 650 to 750° C.

The resulting heat compact-molding was cut into 2mm$^3$, and demagnetization curve with respect to a press direction was evaluated. At this time, the magnetization was conducted after the cut piece was magnetized at 4T in a press direction in a pulse magnetic field. Table 1 shows magnetic characteristics of the heat-treated magnet, which is made of non-treated magnet powder and treated magnet powder with 2% $NdF_3$ by weight. Though Br of the example is reduced by 0.05T, compared with magnet made of non-treated magnet powder, a coercive force was remarkably increased.

TABLE 1

| Magnet powder | Br (T) | $\mu_0H_c$ (T) |
|---|---|---|
| Non-treated magnet powder | 1.10 | 1.31 |
| Treated magnet powder whose $DyF_3$ concentration is 2 wt %. | 1.05 | 1.97 |

In general if Dy is added to a mother phase, it has been known that magnetization decreases due to antiferromagnetic coupling between Dy and Fe. However, since a reduction of magnetization (saturated magnetization), which leads to reduction in the residual magnetic flux density Br in the 2 wt % $DyF_3$ magnet wherein Dy diffuses into the particles was about 0.1T, the reduction of coercive force and of Br was suppressed.

FIG. 1 shows dependency of coercive force on the additive amounts of $DyF_3$. The coercive force of the magnet of the example exhibits an increase two times or more than that of the magnet where Dy is homogeneously added. This is considered that Dy may precipitate at grain boundaries of the magnet powder and in the vicinity thereof. In the resent invention Dy, which is homogeneously added to the mother phase of the magnet is concentrated at grain boundaries so that magnetic characteristics of the magnet can be improved with a smaller additive amount of Dy than that in a conventional method.

Figure 2A:
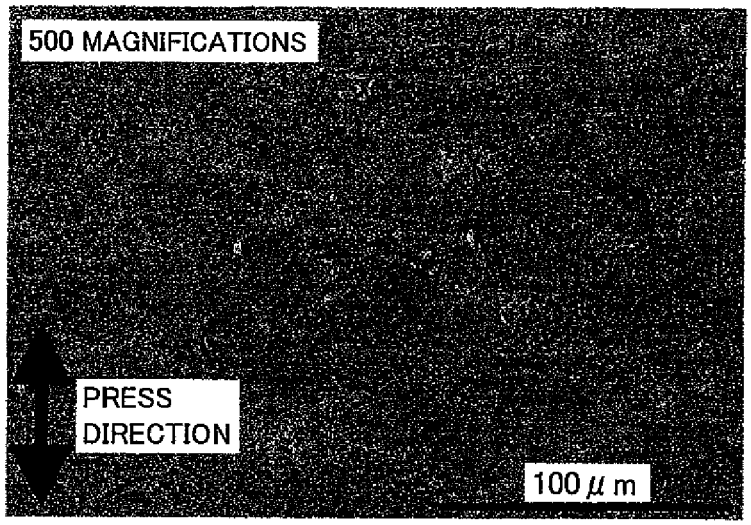
FIG. 2*a* is a scanning electron microscope photograph of a secondary electron image at 500 magnitudes.
Figure 2B:
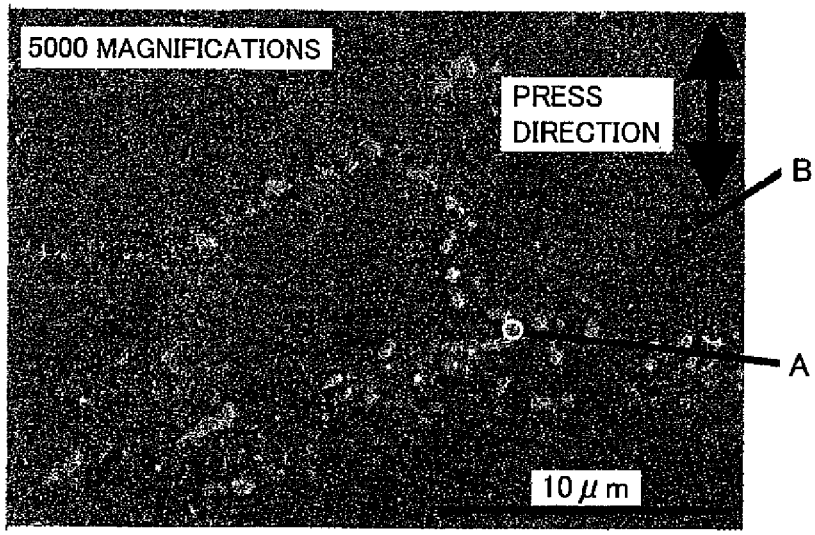
FIG. 2*b* is a scanning electron microscope photograph of a secondary electron image at 5000 magnitudes.
Figure 2C:
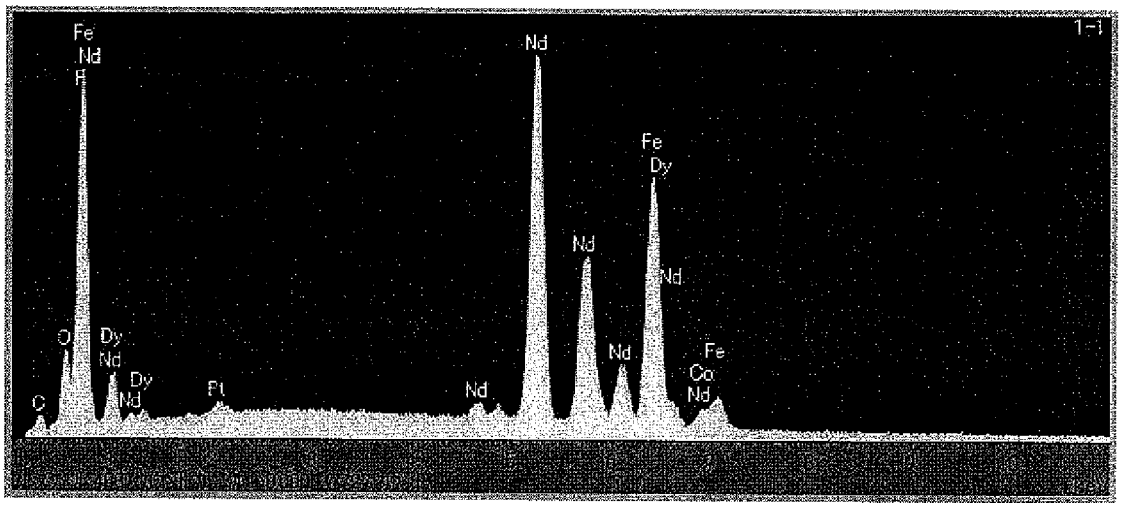
FIG. 2*c* is an EDX spectrum of a point encircled in FIG. 2*b*.
Figure 2D:
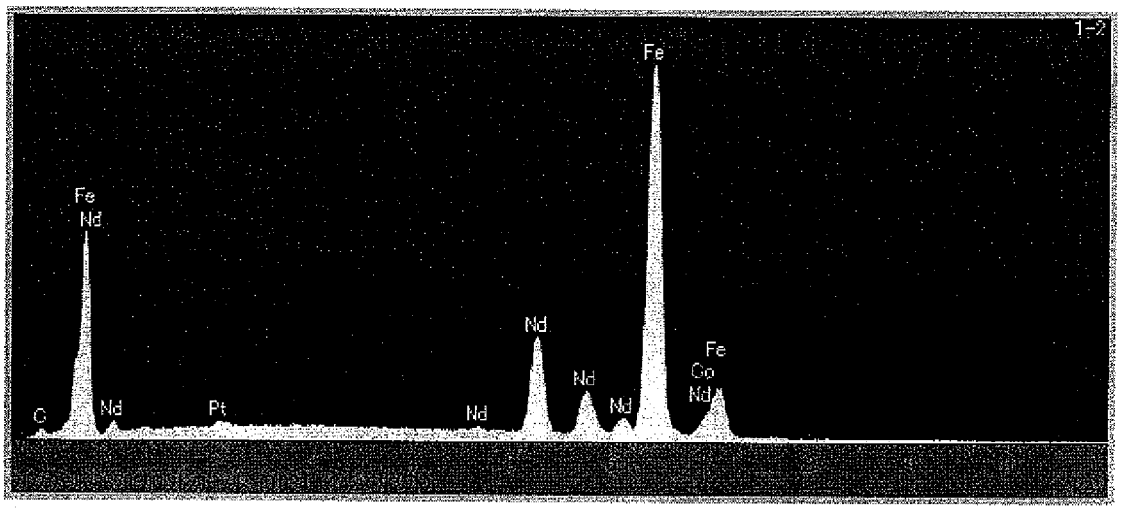
FIG. 2*d* an EDX spectrum of a point encircled in FIG. 2*b*.

FIG. 2*a* shows a SEM photograph of $DyF_3$ 2 wt % heat compact-molding at 500 magnitudes and FIG. 2*b* shows a SEM photograph of the $DyF_3$ 2 wt % heat compact-molding at 5000 magnitudes. FIG. 2*c* shows an EDX element analysis results at the circled point in FIG. 2*b*. FIG. 2*d* shows an EDX element analysis results at the circled point in FIG. 2*b*. From the results shown above, anisotropy of the crystal grains proceeded, and the magnet powder are compacted in the press direction. Further, the magnet powder has a flat form. In this example an average aspect ratio of the magnet powder particles (a length in the press direction/a length in the direction perpendicular to the press direction) was 0.5. From the view point of orientation of the crystal grains, the aspect ratio should preferably be 0.5 or less. A length of the crystal grains in c-axis was 20 to 100 nm, and a length in the direction perpendicular to the c-axis was 200 to 400 nm.

From the results of EDX analysis, it was revealed that fluoride precipitated only at the grain boundaries. Since F does not enter the mother phase, it is thought that the fluoride may be present in the crystal grains. A small amount of Ga was detected at the grain boundaries.

The grain boundaries are constituted mainly by one or more of Nd, Dy, Fe, 0, F and C, and in this example an elemental ratio of Nd:Fe:F was approximately 1:1:2. These chemical compounds of the grain boundaries are featured by presence in an island form. The above magnetic characteristics and SEM analysis features were observed at the center portion and edge portions of the heat compact-molding.

Electric resistivity of the heat compact-molding was evaluated by a four terminal method. As a result, it was revealed that the electric resistivity of the heat compact-molding of $DyF_3$ treated magnetic powder was as high as 1.05 to 2 times that of the heat compact-molding of the non-treated magnetic powder.

In this example a magnet powder using the Dy fluoride compound was investigated. The anisotropic magnets using various coatings of fluorides of rare earth elements and alkaline earth metals had areas where the fluorides are concentrated at the boundaries of the grains of magnet powder and the fluorides work as an insulating film so that the anisotropic magnets of the examples exhibited improved magnetic characteristics and increased specific resistivity, compared to the magnet powder having no coating and magnets using the non-treated magnet powder. Especially, anisotropic rare earth magnets prepared by using magnet powders containing $TbF_3$, $PrF_3$, $HoF_3$, and $NdF_3$ coating that exhibited large anisotropic magnetic field had remarkably improved magnetic characteristics.

Example 2

In example 2 the same magnet powder and the same treating solution as in example 1 were used.

The magnet powder was coated with the $DyF_3$ treating solution in the same manner as in example 1 in a concentration of 1% by weight of $DyF_3$.

The $DyF_3$ treated magnet powder was subjected to heat compact-molding wherein a mixing ratio of the $DyF_3$ treated magnet powder to non-treated magnet powder was 1:9. The mixture was 5.0 grams. The mixed magnet powder was subjected two times to heat compact-molding in the WC mold. The minimum thickness of the resulting molding was 6 mm, and its density was 7.5 g/cm$^3$.

The molding was cut into a piece of 2 mm$^3$. Demagnetization curve of the piece was evaluated at room temperature. The piece was magnetized in a pulse magnetic field with 4T before the evaluation. Table 2 shows magnetic characteristics of the heat compact-molded magnet containing 1 wt % of $DyF_3$.

TABLE 2

| Magnet powder | Br (T) | $\mu_0 H_c$ (T) |
|---|---|---|
| Non-treated | 1.10 | 1.31 |
| Treated powder with $DyF_3$ 1 wt % and non-treated powder (1:9 by weight) | 1.10 | 1.40 |

From the data shown in Table 2, it is apparent that the $DyF_3$ 1 wt % magnet powder mixture remarkably increased the coercive force, keeping Br. In case of a magnet where Dy is added to the mother phase homogeneously, magnetization decreases because of antiferromagnetic coupling between Dy and Fe. On the other hand, the 1 wt % $DyF_3$ magnet powder exhibited a decrease in magnetization by only 0.05T. Accordingly, the rare earth magnet of the present invention exhibited suppressed reduction in Br as well as coercive force.

Figure 3:
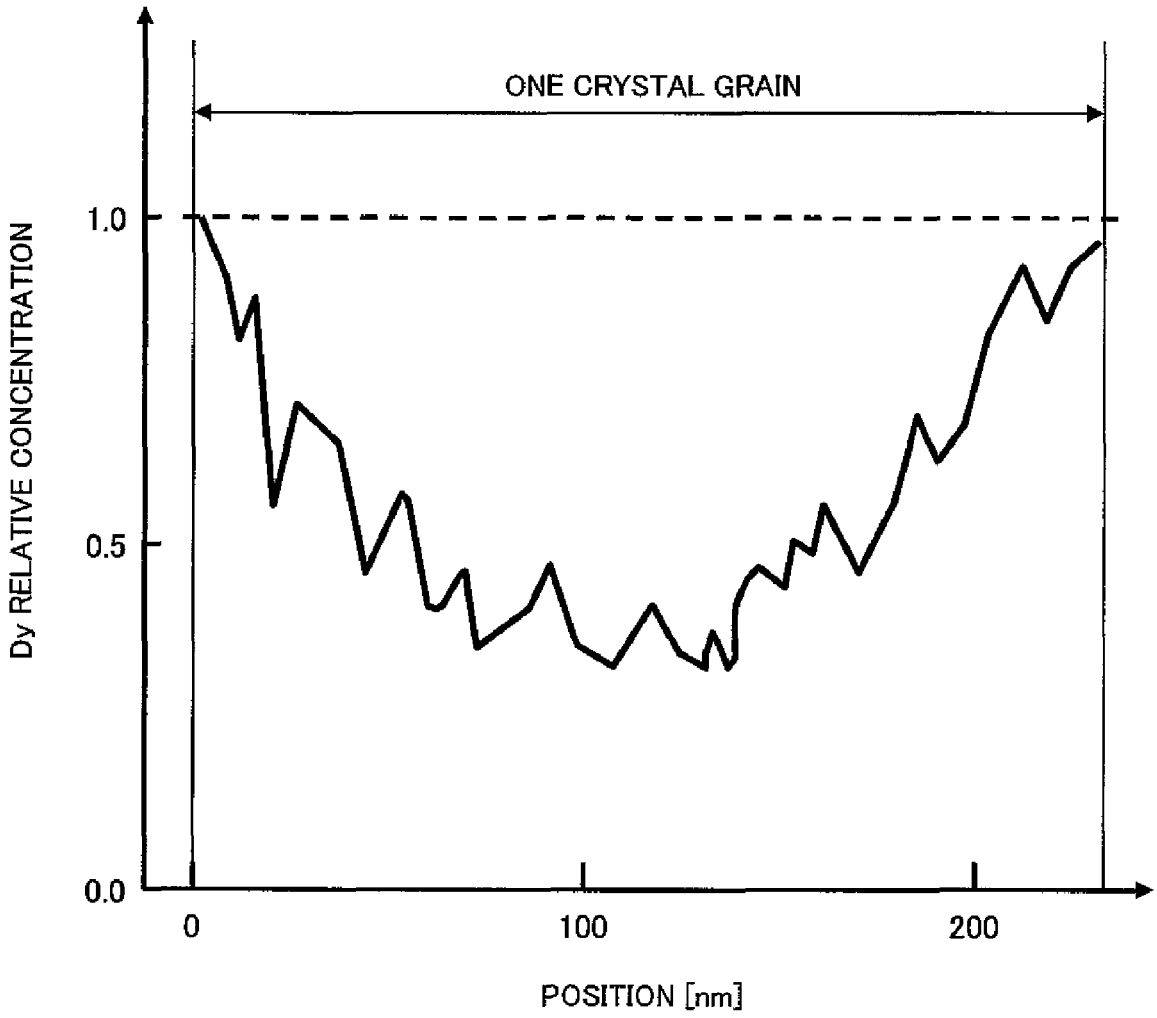
FIG. 3 is a graph showing a concentration of Dy obtained by STEM-EDX line scanning at the center portion of the magnet prepared by the method of example 2. STEM-EDX means energy dispersion X-ray analysis using a scanning transmission electron microscope.

FIG. 3 shows relative values of concentrations of Dy by line scanning with high resolution STEM-EDX analysis. The samples analyzed were cut out with a FIB machining apparatus from the center part of the heat compact-molding.

Anisotropy of orientation of the crystal grains was observed and the magnet powder had flat form whose average aspect ratio (a length in the press direction/a length in the direction perpendicular to the press direction) was 0.5. The average aspect ratio should preferably be 0.5 or less in view of orientation of crystal grains.

A length of the magnet powder in c-axis of the crystal grains was 30 to 100 nm, and a length in a direction perpendicular to the c-axis was 100 to 400 nm.

When a line scanning was conducted with respect to crystal grains having a length of 80 nm in orientation direction and a length of 230 nm in a direction perpendicular to the orientation direction, there was a concentration difference between the center part and the edge part of the crystal grains, which means segregation of Dy at the edge part and boundaries of the crystal grains.

When the line scanning of Dy by EPMA element analysis was conducted in a magnet powder scale, there was a concentration difference between the center part and edge part of magnet powder particle, which means segregation of Dy at the edge and grain boundaries. It was revealed that F segregated only at the grain boundaries and magnet powder boundaries. EPMA is a electron probe micro-analyzer.

Since Dy diffuses into the magnet powder due to diffusion into the mother phase or into the grain boundaries from magnet powder grain boundaries, a concentration of Dy at the edge of the crystal grains may be higher than at the inside of the crystal grains. A small amount of Ga was observed only at the grain boundaries.

The grain boundaries were constituted mainly by at least one of Nd, Dy, Fe, O, F and C. In this example, an elemental ratio of Nd:Fe:F was 1:1:2. These chemical compounds at the grain boundaries are present intermittently as an island form.

The above features of magnetic characteristics and elemental analysis were observed in the center part and an edge part of the heat compact-molding. Further, electric resistivity of the $DyF_3$ treated magnet powder, which was measured by a four terminal method, was as high as 1.05 to 1.3 times that of non-treated magnet powder.

In this example Dy was used, but fluoride coated magnet powder and anisotropic magnets prepared by using other fluorides of rare earth elements and alkaline earth metals exhibited improved magnetic characteristics and increased electric resistivity, compared with non-treated magnet powder and anisotropic magnets prepared by using the non-treated magnet powder. Especially, the magnet powder and isotropic magnets using $TbF_3$, $PrF_3$, $HoF_3$ and $NdF_3$ showed remarkably improved magnetic characteristics.

Example 3

Thermal resistance of the hot-compact molded magnet prepared in example 1 was evaluated. The thermal resistance was derived by reduction in magnetization was measured after the magnet was maintained at high temperatures for 10 minutes, the temperatures were returned to 25° C. The hot compact-molded magnet using rapid quenched magnet powder has finer particle size than that of calcined magnet, thermal demagnetization is suppressed and has good thermal resistance.

The hot thermal compact-molded magnet in example 1 showed thermal resistance better by 90 than the calcined magnet having a similar coercive force to the magnet of example 1. The heat compact-molded magnets had thermal demagnetization of 100° C., while the sintered magnets showed the thermal demagnetization of 10° C. A temperature constant of Br was in a range of −0.07 and −0.13.

Example 4

Magnet powder prepared in a similar manner as in example 1 was investigated.

A treating solution for forming a coating of fluorides of rare earth elements or alkaline earth metals was prepared as follows. An example is $NdF_3$. After 4 grams of neodymium acetate or neodymium nitrate was dissolved in 100 mL of water, hydrofluoric acid solution with 1% was gradually added to the Nd solution in a 90% equivalent amount sufficient to produce $NdF_3$ under stirring to produce gelatinous $NdF_3$.

After the supernatant was removed by centrifugation, ethanol in an equal amount to the gel was added to the residue. Stirring and centrifugation were repeated 3 to 10 times to remove anionic ions to thereby produce an almost transparent colloidal $NdF_3$ methanol solution (concentration: $NdF_3$/methanol=1 g/5 mL). The stirring and centrifugation were repeated 10 times.

A coating method for forming a coating of fluorides of rare earth elements or alkaline earth elements on the rare earth magnet was carried out as follows.

5 mL of $NdF_3$ coating solution was added to 100 g of rare earth magnet powder having an average particle size of 100 to 200 μm, and the mixture was stirred until the entire was wet. Methanol in the $NdF_3$ coating solution was removed in a reduced pressure of 2 to 5 torr.

The rare earth magnet powder after the methanol removal was put in a quartz boat, and subjected to heat treatment at 200° C. for 30 minutes and 350° C. for 30 minutes in a reduced pressure of $1\times10^{-3}$ Pa. As a result, the magnet powder was treated to obtain magnet powder with 1 wt % $NdF_3$.

The resulting magnet powder was coated with a $DyF_3$ treating solution prepared in the similar manner as in $NdF_3$ treating solution, and the treated magnet powder was heat treated at 200° C. for 30 minutes and 350° C. for 30 minutes in a reduced pressure of $1\times10^{-3}$ Pa. The reason of forming the dual coating of the fluorides is that since oxy-fluoride of Nd is stabler than oxy-fluoride of Dy, diffusion of Dy into grains at high temperature is suppressed. This method is applicable to sintered or calcined magnet.

The magnet powder obtained in the above method was heat compact-molded in accordance with the same method as in example 1. The resulting molding had the minimum thickness of 6mm and a density of 7.5 g/cm$^3$. Since the size of the mold can be changed, there is no limit to a thickness of the magnet in theory.

The molding was cut into a piece of 2mm$^3$, and demagnetization curve at room temperature in the press direction was measured. The measurement was conducted after the piece was magnetized in a pulse magnetic field of 4T. Br was almost the same as that of the piece in example 1 and the coercive force was remarkably increased.

In case of a magnet where Dy is homogeneously added to a mother phase, magnetization decreases because of antiferromagnetic coupling between Dy and Fe. Reduction in magnetization of magnet piece wherein Dy diffuses into crystal grains when the piece is treated 1 wt % $DyF_3$ was 0.05T. Therefore, the $DyF_3$ treatment suppresses reduction in coercive force and Br as well.

Magnetic characteristics were improved by three times the characteristics of magnet where Dy was added homogeneously in the mother phase. Observation of a cross section with SEM showed that crystal grains were packed along the press direction to exhibit anisotropy and magnet powder had a flat form.

In this example an average aspect ratio was 0.5. The aspect ratio should preferably be 0.5 or less from the viewpoint of orientation of crystal grains. A length of crystal grains in c-axis was 20 to 100 nm, and a length in a direction perpendicular to c-axis was 200 to 400 nm.

EDX elemental analysis showed that fluoride precipitated only at the grain boundaries. Since F does not enter the mother phase, it may be present between crystal grains constituting the magnet powder. An amount of Ga was small, which is present only at the grain boundaries. The grain boundaries of the magnet powder were constituted by Nd, Tb, Fe, O, F and C. These chemical compounds are present intermittently around the magnet powder particle as an island form. The magnetic characteristics and features observed with SEM were in the center part of the molding and edge part as well. An electric resistivity was measured by a four terminal method. The electric resistivity of the molding treated with $TbF_3$ according to the present invention exhibited 1.05 to 2 times that of the magnet using non-treated magnet powder.

In this example fluoride of Tb was investigated. Magnet powder treated with other fluorides of rare earth elements and alkaline earth metals and anisotropic magnets using the magnet powder exhibited improved magnetic characteristics and increased electric resistivity, compared to the non-treated magnet powder and anisotropic magnet prepared by the die setup method from the non-treated magnet powder, wherein the crystal grains are oriented by plastic flow. Especially, magnet powder having a coating of at least one of $TbF_3$, $PrF_3$, $HoF_3$ and $NdF_3$ and an anisotropic magnet prepared from the above magnet powder exhibited remarkably improved magnetic characteristics.

Example 5

Magnet powder having as a main phase $Nd_2Fe_{14}B$ and having an average particle size of 5 μm and a boride or rare earth element rich phase in an amount of 1 wt % was prepared. The magnet powder was charged in a metal mold and compact-molded in a magnetic field of 1T under a load of 1 ton/cm$^2$. Then, the molding was calcined at 1000 to 1150° C. in a reduced pressure of $1\times10^{-3}$ Pa. The resulting molding was surface-polished to form a magnet with 10×10×5 cm$^3$. An orientation direction is the 5 mm side. The resulting magnet exhibited a coercive force of 10 kOe at 25° C.

The resulting magnet was exposed to steam of Dy at 500 to 900° C. to effect diffusion of Dy into the inside of the magnet along the crystal grain boundaries. The magnet was heated to 700° C. with Magrise manufactured by ULVAC Inc. The grain boundaries of the resulting magnet was subjected to STEM-EDX analysis, and the presence of rare earth element oxide containing Dy was confirmed. A coercive force was 12 to 18kOe.

The magnet was immersed in a DyFx solution. The DyFx solution was prepared by $Dy(CH_3COO)_3$ in water and adding HF to the $Dy(CH_3COO)_3$ solution to produce gelatinous $DyF_3.XH_2O$ or $DyF_3.X(CH_3COO)$ (X is a positive number). The resulting gel was subjected to centrifugation to remove a solvent, and then ethanol was added to the gel to make it a DyFx state. A detailed process for preparing the treating solution of the fluorides of rare earth elements or alkaline earth metals is shown below.

(1) 4 grams of dysprosium acetate, which is well soluble in water, was put in 100 mL water, and it was completely dissolved under stirring with use of a shaker or a supersonic stirrer.
(2) Hydrogen fluoric acid diluted to 10% was added by an amount equivalent to form DyFx (x=1-3) to precipitate gel.
(3) The gel precipitate of DyFx was stirred for 1 hour with the supersonic stirrer.
(4) After centrifugation at a rotation number of 4000 to 6000 rpm, the supernatant was removed, and methanol was added by an amount equal to the residue.
(5) After the methanol solution containing the gel DyFx cluster was stirred to make a suspension solution, the solution was stirred for at least 1 hour with the supersonic stirrer.
(6) The steps (4) and (5) were repeated 10 times until anionic ions such as acetic acid ions or nitric acid ions were detected.

In case of DyF series almost transparent sol DyFx was obtained. As a treating solution, a methanol solution of a concentration of 1 g/5 ml DyFx was used. Immersion and vacuum degassing were conducted in accordance with an amount to be coated. The operation was repeated 5 times.

Thereafter, DyF was thermally diffused at 300 to 900° C. into the magnet. The heating temperature was 700° C. Although a rare earth element oxide was already formed at grain boundaries, Dy, C and F for constituting fluoride compounds diffused along the grain boundaries to effect mutual diffusion so as to exchange with Nd constituting crystal grains. In the diffusion along the grain boundaries it is thought that because the oxy-fluoride is stabler than rare earth element oxide containing Dy, the above diffusion may take place.

It has been revealed that oxy-fluorides or fluoride compounds are formed at grain boundary triple points, which are constituted by $DyF_3$, $DyF_2$, DyF, etc. Further, it was also confirmed that the oxy-fluorides and fluoride compound contained C. Fluorine atoms were detected at grain boundaries, and Dy was concentrated in a rage from 1 nm to 500 nm from the grain boundaries on average. A concentration of Dy at a point of 100 nm from the center of the grain boundaries was 1/2 to 1/10 in a ratio of Dy to Nd (Dy/Nd). The above method of producing magnets by utilizing thermal diffusion from the surface of the magnets is particularly useful for high magnetization magnets having a thickness of 10 mm.

Example 6

Magnet powder having $Nd_2Fe_{14}B$ structure as a main phase and about 1 wt % boride or rare earth element rich phase was prepared as NdFeB series powder. The powder had an average particle size of 5 μm. The magnet powder was put in a metal mold to produce a preliminary molding in a magnetic field of 1T under a load of 1 ton/cm2. The molding was calcined at 1000 to 1050° C. in a reduced pressure of $1\times10^{-3}$ Pa. The molding was subjected to surface polishing to a size of $10\times10\times5$ $mm^3$. The orientation is in the 5 mm direction. A coercive force at 25° C. was 10 kOe.

The molding was exposed to vapor of Dy at a temperature of 500 to 900° C. to diffuse Dy along the grain boundaries of crystal grains. In this example, the molding was heated to 700° C. with Magrise manufactured by Ulvac, Inc. The resulting magnet was subjected to STEM-EDX analysis to investigate grain boundaries. Rare earth oxides containing Dy were present at the grain boundaries. A coercive force was in a range of from 12 to 18 kOe.

The resulting magnet was immersed in a NdFx solution. The NdFx solution was prepared by dissolving $Nd(CH_3COO)_3$ in water, and HF was added to the solution to produce gelatinous $NdF_3.XH_2O$ or $NdF_3.X$ $(CH_3COO)$ (x is a positive number). The resulting gel solution was centrifuged to remove the solvent, and then ethanol was added to make NdFx state.

The treating solution for forming rare earth fluorides or alkaline earth metal fluorides coating was prepared as follows.

(1) 4 grams of water dissoluble neodymium acetate salt was dissolved in 100 mL of water under stirring with a shaker or a supersonic stirrer.
(2) Hydrofluoric acid with 10% concentration was added to the solution to generate NdFx (x=1 to 3) in an equimolar amount.
(3) The solution containing the NdFx gel precipitate was stirred with a supersonic stirrer for at least 1 hour.
(4) After the gel solution was centrifuged under a rotation number of 4000 to 6000 rpm, and supernatant was removed.
(5) After the methanol solution containing the gelatinous NdFx precipitate cluster was stirred to make it suspension solution, the solution was stirred for at least 1 hour with a supersonic stirrer.
(6) The steps (4) and (5) were repeated 10 times until anionic ions such as acetic acid ions and nitric acid ions are not detected.

In case of NdF series, an almost transparent sol solution of NdFx was obtained. As a treating solution for forming a coating a methanol solution of a concentration of 1 g/5 mL of NdFx was used. The calcined molding was immersed in the treating solution, and then subjected to vacuum degassing to remove the solvent.

Immersion and vacuum degassing were properly repeated in accordance with a required amount to be coated. In this example the immersion and vacuum degassing were repeated 5 times. Thereafter, the treated molding was heated to 300 to 900° C. to diffuse NdF into the magnet. In this example, the magnet was heated to 700° C.

Although rare earth oxides containing Dy were already formed at grain boundaries, Nd, C and F that constitute the fluoride compounds diffuse along the grain boundaries. Because in case of diffusion along the grain boundaries oxy-fluorides and oxy-fluoride of neodymium are stabler than rare earth element oxides containing Dy, it is thought that the above diffusion takes place.

Since $NdF_3$ and Nd compounds suppress diffusion of Dy, they suppress diffusion of Dy that is already present t the grain boundaries into the inside of grains or to concentrate in the vicinity of the grain boundaries. Accordingly, oxy-fluorides and fluoride compounds containing Nd and Dy are formed more at the grain boundary three points.

Further, it was confirmed that the oxy-fluorides and fluoride compounds contained C. Fluorine atoms were detected at the grain boundaries, and Dy was concentrated within a distance of 1 to 500 nm on average from the grain boundaries. A concentration ratio of Dy to Nd (Dy/Nd) of Dy within 100 nm from the center of the grain boundaries was 1/2 to 1/10. The method utilizing thermal diffusion from the surface of the magnet is particularly useful for manufacturing high coercive force magnet with a thickness of 10 mm or less.

What is claimed is:

1. A rare earth magnet having a composition represented by RTB wherein R denotes a rare earth element, T a transition metal and B boron, the magnet being composed of particles of magnetic powder constituted by crystalline particles, wherein the particles of the magnetic powder have a flat form in which a ratio of a short diameter to a long diameter is 0.5 or less, wherein an element Rm having a magnetic anisotropy higher than that of the rare earth element is contained in the surface and inside of the magnet constituted by the magnet powder, a concentration of Rm in the surface of the crystalline particles being higher than that of the inside thereof, wherein a size of the crystalline particles in c-axis is 20 to 100 nm, and a size in a direction perpendicular to the c-axis is 100 to 400 nm, and wherein an oxy-fluoride and carbon are present at least at crystal grain boundaries of the particles of the magnet powder.

2. The rare earth magnet according to claim 1, wherein the oxy-fluoride at the boundaries of the particles is present in islands.

3. The rare earth magnet according to claim 1, wherein a minimum thickness of the magnet is 5 mm or more.

4. The rare earth magnet according to claim 1, wherein Rm is at least one member selected from the group consisting of Nd, Tb, Dy, Pr, Ce and Ho.

5. The rare earth magnet according to claim 1, wherein the magnet powder contains Ga and at least one member selected from the group consisting of Nd, Pr, Fe, Co and B.

6. A rare earth magnet having a composition represented by RTB wherein R denotes a rare earth element, T a transition metal and B boron, wherein the magnet is composed of magnet powder constituted by crystalline particles, wherein the particles of the magnetic powder have a flat form, wherein an oxy-fluoride and carbon are present at least at crystal grain boundaries of the particles of the magnet powder, wherein an element Rm having a magnetic anisotropy higher than that of the rare earth element is contained in the surface and inside of the magnet constituted by the magnet powder, wherein a concentration of Rm in the surface of the magnet powder is higher than inside of the magnet powder, and wherein a size of the crystalline particles in c-axis is 20 to 100 nm, and a size in a direction perpendicular to the c-axis is 100 to 400 nm.

7. The rare earth magnet according to claim 6, wherein Rm is at least one member selected from the group consisting of Tb, Dy and Pr, and wherein R is Nd, T is Fe.

8. The rare earth magnet according to claim 1, wherein the magnet is formed by compact-molding the magnetic particles at a temperature of 200 to 900° C.

9. The rare earth magnet according to claim 1, wherein the magnet is formed by compact-molding the magnetic particles at a temperature of 500 to 800° C.

10. The rare earth magnet according to claim 1, wherein the magnet is formed by compact-molding the magnetic particles at a temperature of 650 to 750° C.

11. The rare earth magnet according to claim 1, wherein the magnet is formed by compact-molding the magnetic particles at a temperature of 700 to 900° C.

12. The rare earth magnet according to claim 11, wherein a thickness of the magnetic powder is changed by 75% in the mold during the compact-molding.

* * * * *